US005232157A

United States Patent [19]

Laffrey

[11] Patent Number: 5,232,157

[45] Date of Patent: Aug. 3, 1993

[54] INSECT RESISTANT SPRAY EMITTER

[75] Inventor: Peter R. Laffrey, North Plympton, Australia

[73] Assignee: Philmac Pty. Ltd., North Plympton, Australia

[21] Appl. No.: 790,258

[22] Filed: Nov. 8, 1991

[30] Foreign Application Priority Data

Nov. 26, 1990 [AU] Australia ..... PK3512

[51] Int. Cl.[5] ..... B05B 3/08

[52] U.S. Cl. ..... 239/222.17; 239/381

[58] Field of Search ..... 289/222.11, 222.17, 289/382, 383, 380, 381, 223, DIG. 1, 233

[56] References Cited

U.S. PATENT DOCUMENTS

| | | | |
|---|---|---|---|
| 599,330 | 2/1898 | Hale | 239/524 |
| 974,176 | 11/1910 | Newman | 239/222.17 |
| 1,763,980 | 6/1930 | Nelson | 239/222.17 |
| 3,008,558 | 11/1961 | Bennett et al. | 192/12 |
| 3,030,032 | 4/1962 | Luhman, Jr. | 239/383 |
| 4,121,769 | 10/1978 | Drori | 239/222.17 |
| 4,560,108 | 12/1985 | Rubuinstein | 239/222.17 |
| 4,660,765 | 4/1987 | Rosenburg | 239/383 |
| 4,754,925 | 7/1988 | Rubinstein | 239/230 |
| 4,760,958 | 8/1988 | Greenberg | 239/222.21 |
| 4,763,839 | 8/1988 | Greenberg | 239/222.17 |
| 4,783,005 | 11/1988 | Rosenberg | 239/381 |
| 4,805,838 | 2/1989 | Greenberg | 239/222.17 |
| 4,817,869 | 4/1989 | Rubinstein | 239/222.17 |
| 4,819,872 | 4/1989 | Rosenberg | 239/222.17 |
| 5,007,586 | 4/1991 | Cohen | 239/222.17 |

FOREIGN PATENT DOCUMENTS

| | | | |
|---|---|---|---|
| 934448 | 5/1948 | France . | |
| 990778 | 9/1951 | France | 239/222.17 |
| 103160 | 10/1962 | Netherlands | 239/383 |
| 1613 | 1/1910 | United Kingdom | 239/222.17 |
| 1343337 | 1/1974 | United Kingdom | 239/381 |
| 1442662 | 7/1976 | United Kingdom . | |

*Primary Examiner*—Andres Kashnikow
*Assistant Examiner*—Christopher G. Trainor
*Attorney, Agent, or Firm*—Brown, Martin, Haller & McClain

[57] ABSTRACT

A spray emitter (10) has a fixed head (11) and a rotary deflector (22). The head (11) has a jet passage (14) extending through it to direct a jet of water onto a central point (24) of the deflector where its deflecting surface (23) converges. The converging surface closes the mouth of the jet passage (14) under no flow conditions but is lifted away from the mouth under the water flow conditions, and the water flowing upwardly over the deflector surface (23) is intercepted by blades (28) which extend outwardly from the upper portion of the deflector surface. The spray is emitted as a plurality of streams each having a large component of horizontal direction so as to provide a low trajectory.

6 Claims, 1 Drawing Sheet

INSECT RESISTANT SPRAY EMITTER

This invention relates to a spray emitter for emitting an irrigation spray, and having a jet passage which impinges a jet onto a deflector which has an outwardly and upwardly flaring deflector surface.

BACKGROUND OF THE INVENTION

Spray emitters of the above type are well known and in common use, the most commonly used "ant resistant" emitter utilises a rotor which falls back into a "cup", and has a flange which overlies the cup lip thereby closing the cup in a shut-down mode to prevent ingress of dust and insects into the nozzle. Two components are required solely for the purpose.

PRIOR ART

A very large amount of prior art exists in irrigating spray emitters, but the most relevant ones known to the applicant include the U.S. Pat. No. 3,006,558 in the name of A W Jacobs wherein an upwardly flaring deflector surface contained a plurality of channels and surmounted a housing which contained a bearing, in which a shank of the deflector was journalled for both rotational and axial movement.

In the U.S. Pat. No. 4,121,769 in the name of Drori, a liquid spraying head was rotatably mounted to a nozzle and included an internal chamber having a shaped inlet orifice receiving the jet from the nozzle and outlet orifices which produced lateral jets, the reaction force of which rotated the head. The shaped inlet orifice included side walls converging towards each other in the direction of the inlet chamber, and these walls were engaged by a complementary surface on the liquid spraying head which dropped under its own weight when there was no liquid flow.

In the U.S. Pat. No. 4,754,925, Rubinstein, a miniature sprinkler was provided with a vertically extending nozzle and a flow diverter having an axially extending inlet in register with the outlet of the nozzle, and described an arrangement where the inlet in the diverter merged into two side outlets extending horizontally from which water was emitted in the form of jets, and a drive apparatus coupled to the diverter in such a position that at least part of the flow of the diverter impinged on the driver apparatus (typically a turbine). In one embodiment described in that specification, when no water flowed through the nozzle the diverter body dropped downwards so that the outlets were covered by the walls of a cup-shaped member to prevent entry of insects and dirt into the nozzle.

BRIEF SUMMARY OF THE INVENTION

This invention has for its main objects the provision of a low cost spray emitter, particularly a micro-spray emitter, comprising a minimum number of parts which are easily assembled or dismantled, and a simple means for reducing the incidence of blocking, and also means to provide an improved spray distribution so that an area being sprayed would have fewer uneven parts of high density spray and low density spray.

Thus in this invention, a spray emitter has a fixed head and a rotary deflector, the head having a jet passage extending through it to direct a jet of water onto a central point of the deflector where its deflecting surface converges, the converging surface closing the mouth of the jet passage under no flow conditions but being lifted away from the mouth under the water flow conditions, and the water flowing upwardly over the deflector surface being intercepted by blades which extend outwardly from the upper portion of the deflector surface, the spray being emitted as a plurality of streams each having a large component of horizontal direction so as to provide a low trajectory.

More specifically, the invention consists of an insect resistant irrigating spray emitter comprising a head containing a flow constraining surface defining a jet passage in a lower portion and respective annular surfaces in the lower portion and in an upper portion of the head defining bearings coaxial with the jet passage, a deflector having lower and upper bearing surfaces respectively co-operable with said lower and upper head bearings and being guided thereby for both axial and vertical movement, the deflector having a downwardly converging annular deflecting surface, a lower portion of which terminates in a point which, under no-flow conditions, lies within said jet passage with the deflecting surface closing the mouth thereof, and circumferentially spaced deflector blades outstanding from an upper portion of the deflecting surface, the shape, weight and dimensions of the deflector being such that liquid flow through the jet passage lifts the deflector therefrom, and the deflector deflects water passing over its deflecting surface and between the deflector blades as a plurality of streams each having a component of horizontal direction.

BRIEF DESCRIPTION OF THE PREFERRED EMBODIMENT

An embodiment of the invention is described hereunder in some detail with reference to and is illustrated in the accompanying drawings in which.

Figure 1:
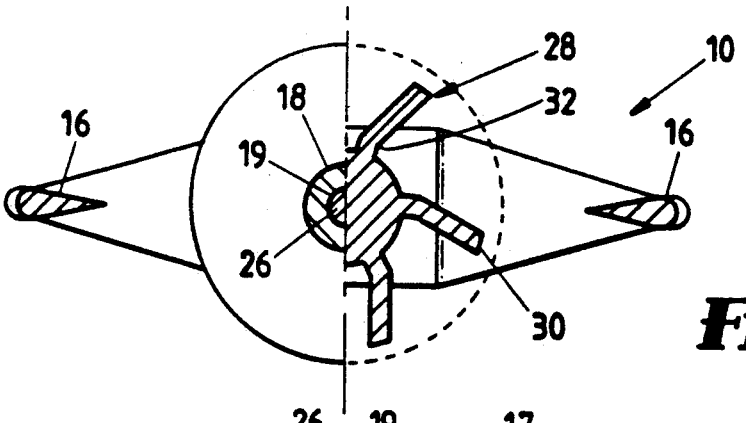
FIG. 1 is a plan section taken on two planes of a spray emitter.
Figure 2:
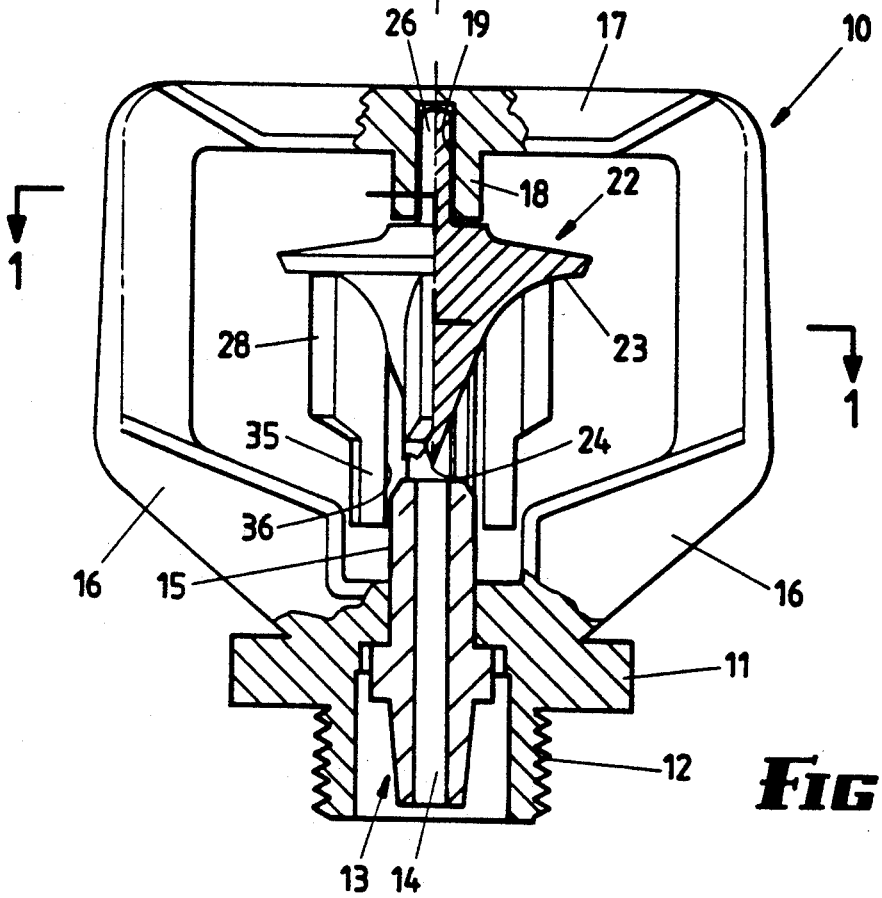
FIG. 2 is a half sectioned elevation which shows the two planes of section of FIG. 1.

In this embodiment, an insect resistant irrigating spray emitter 10 comprises a head 11 having a threaded tail 12 by which it can be secured to a water supply line. The head 11 contains a jet tube 13 which has an inner cylindrical surface 14 which constrains passage of water therethrough into a jet, the jet tube 13 projecting upwardly to provide an outer bearing surface 15. In this embodiment the head is provided with two side wings 16 which extend upwardly from its lower portion (at least one wing being necessary), and the side wings 16 are joined at their upper ends in the upper portion of the head by a bridge 17 which contains a depending boss 18 which has an internal bearing surface 19 coaxial with the two surfaces 14 and 15 of the jet tube 13.

A deflector 22 has a downwardly converging annular deflecting surface 23 which flares in an upward direction, but terminates at its lower end in a point 24 which, upon water flow, is located just above the upper end of the jet tube 13. Upon no-flow conditions however the weight of the deflector 22 is such that it drops and the deflecting surface 23 cooperates with the mouth of the jet tube 15 to close the jet tube.

The upper end of the deflector is provided with an upwardly extending spigot 26 which is journalled in the bearing surface 19 of the boss 18.

Figure 3:
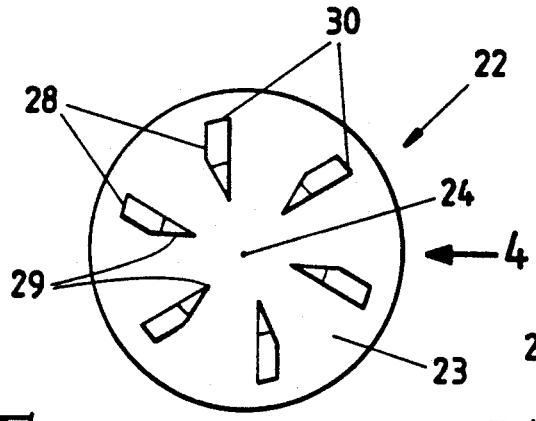
FIG. 3 is an underside view of the deflector.
Figure 4:
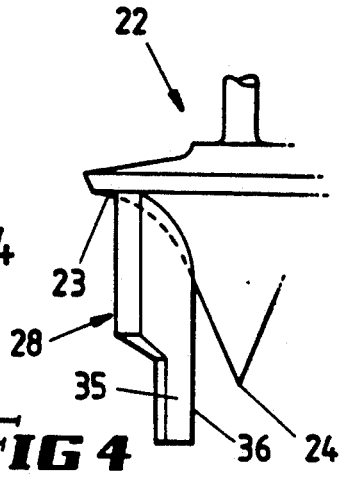
FIG. 4 is a fragmentary view taken in the direction of arrow 4 illustrating an elevational shape of one of the deflector blades.

Depending from the flared deflecting surface 23 there is a plurality of blades 28 which are circumferentially spaced, but as best seen in FIGS. 1 and 3. These blades 28 do not extend radially but are inclined with respect to the radial directions by an amount sufficient to impart rotation to the deflector due to reaction of water when flowing over the deflecting surface 23. The inner vertical edges 29 are chamfered in one direction to reduce turbulence imparted to the water flow by the blades, and extend outwardly at 30 with parallel walls. Where the blades intercept the deflecting surface 23, they do so with a curved conformation at 32 and this also assists in reducing turbulence, the net result of reducing turbulence being to provide large droplets which, with the arrangement shown, will give a substantially even distribution of irrigating water over a major portion of the irrigated area.

There are essentially at least three deflector blades, each having a downwardly extending finger 35, the inner edges 36 of which lie adjacent to the bearing surface 15 of the jet tube 13 with sufficient clearance to avoid drag, but close enough to stabilise the deflector 22 during its rotation upon water flow. However, the moulding of the deflector 22 is of a resilient material so that even with six blades as illustrated, it is easy to deflect the fingers 35 for positioning or removing the deflector 22 from the head 11. The arrangement which has been illustrated includes a jet tube 13 to provide the bearing surface 15 and also the flow constraint surface 14. Obviously this can be part of the head moulding, although providing independent jet tubes 13 gives a user the opportunity to vary the diameter of the flow constraining surface 14 for different applications. Even when a jet tube 13 is supplied, the entire sprinkler comprises only three parts, and without the jet tube only two parts, both of which are simple mouldings. Although it is extremely unusual for rotation to stop due to debris, in the unlikely event that it does stop, nevertheless there are still six streams of irrigating water which will radiate outwardly from the deflector.

The surface finish is a matter of some importance in the reduction of turbulence, and desirably the surface finish has a smoothness of 0.1 ra.

I claim:

1. An insect resistant spray emitter comprising:

a head having a jet tube in and projecting upwardly from a lower portion thereof, said jet tube having an inner flow constraining surface defining a jet passage and an outer surface defining a head lower bearing surface, said head having an annular surface in an upper portion thereof coaxial with said head lower bearing surface defining a head upper bearing surface, said jet passage having a mouth at an uppermost portion of said jet tube;

a deflector having a downwardly converging annular deflecting surface, an upper portion defining a deflector upper bearing surface co-operable with said head upper bearing surface and being guided thereby for both axial and rotational movement, at least three deflector blades extending downwardly, and a lower portion terminating in a point which, under no-flow conditions, lies within said jet passage with the deflecting surface closing said mouth of said jet passage, each said deflector blade having a respective finger having an inner surface defining a deflector lower bearing surface co-operable with said head lower bearing surface and being guided thereby for both axial and rotational movement; and the shape, weight and dimensions of the deflector being such that liquid flow through the jet passage lifts the deflector therefrom, and the deflector deflects water passing over its deflecting surface and between the deflector blades as a plurality of streams each having a component of horizontal direction.

2. An insect resistant irrigating spray emitter according to claim 1 wherein said head upper portion extends laterally and contains a hollow boss with an inner surface which constitutes said upper head bearing surface, and at least one side wing joins said lower and upper head portions.

3. An insect resistant irrigating spray emitter according to claim 2 wherein said deflector has an upwardly extending spigot the outer surface of which constitutes said upper bearing surface thereof and is contained within said hollow boss.

4. An insect resistant irrigating spray emitter according to claim 1 wherein said downwardly converging annular deflecting surface flares upwardly and outwardly from said point.

5. An insect resistant irrigating spray emitter according to claim 1 wherein each said deflector blade diminishes in depth towards its radially inner edge.

6. An insect resistant irrigating spray emitter according to claim 4 wherein said fingers are circumferentially spaced and are sufficiently deformable and resilient to pass said projecting jet tube in a lateral direction upon assembly to or removal from the head.

* * * * *